United States Patent [19]

Manoly

[11] 4,005,329

[45] Jan. 25, 1977

[54] SLOW-WAVE STRUCTURE ATTENUATION ARRANGEMENT WITH REDUCED FREQUENCY SENSITIVITY

[75] Inventor: Arthur E. Manoly, Rancho Palos Verdes, Calif.

[73] Assignee: Hughes Aircraft Company, Culver City, Calif.

[22] Filed: Dec. 22, 1975

[21] Appl. No.: 643,048

[52] U.S. Cl. ..... 315/3.5; 315/3.6; 315/39.3; 330/43

[51] Int. Cl.[2] ..... H01J 25/34

[58] Field of Search ..... 315/3.5, 3.6, 39.3; 330/43; 331/82

[56] References Cited

UNITED STATES PATENTS

| | | | |
|---|---|---|---|
| 3,329,855 | 7/1967 | Landsbergen | 315/3.5 |
| 3,368,103 | 2/1968 | Thall | 315/3.5 |
| 3,466,493 | 9/1969 | Phillips | 315/3.5 |
| 3,519,964 | 7/1970 | Chorney et al. | 315/3.5 X |
| 3,670,197 | 6/1972 | Unger | 315/3.5 |
| 3,903,449 | 9/1975 | Scott et al. | 315/3.5 |

*Primary Examiner*—Saxfield Chatmon, Jr.
*Attorney, Agent, or Firm*—Paul M. Coble; W. H. MacAllister

[57] ABSTRACT

In the disclosed attenuation arrangement a plurality of axially extending boron nitride support rods having a substantially rectangular cross-section are disposed about the peripheral surface of a helical slow-wave structure. An attenuating coating is provided on the substantially radially extending opposing lateral surfaces of each rod, with the substantially circumferentially extending opposing lateral rod surfaces being free from attenuating material.

3 Claims, 2 Drawing Figures

SLOW-WAVE STRUCTURE ATTENUATION ARRANGEMENT WITH REDUCED FREQUENCY SENSITIVITY

Figure 1:
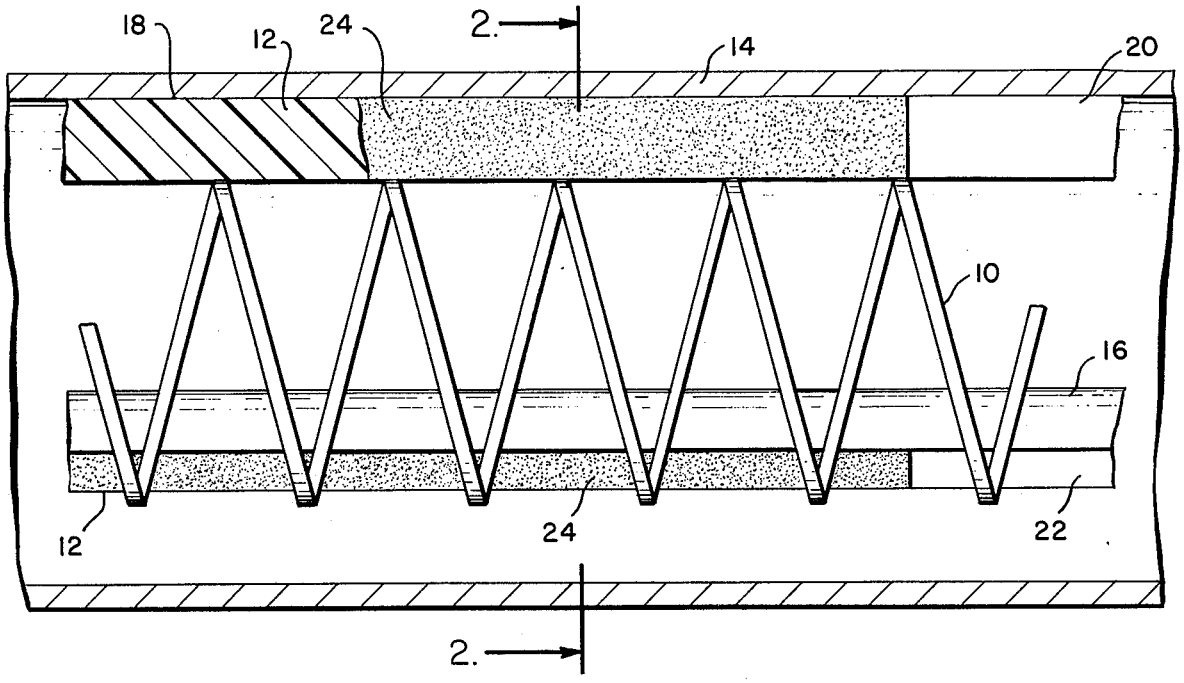

This invention relates generally to microwave devices, and more particularly relates to a slow-wave structure support rod attentuation arrangement for use in traveling-wave tubes.

In traveling-wave tubes a stream of electrons is caused to interact with a propagating electromagnetic wave in a manner which amplifies the electromagnetic wave energy. In order to achieve the desired interaction, the electromagnetic wave is propagated along a slow-wave structure, such as an electrically conductive helix wound about the path of the electron stream. The slow-wave structure provides a path of propagation for the electromagnetic wave which is considerably longer than the axial length of the structure so that the traveling wave may be made to effectively propagate at nearly the velocity of the electron stream. Slow-wave structures of the helix type are usually supported within a vacuum envelope by means of a plurality of equally circumferentially spaced dielectric rods disposed between the slow-wave structure and the envelope.

A recent advance in the traveling-wave tube art has been to employ slow-wave structure support rods of substantially rectangular cross-section rather than the previously used circular cross-section. A rectangular support rod configuration provides a greater contact area for improved heat conduction away from the slow-wave structure.

In order to preclude undesired oscillations in traveling-wave tubes it is often necessary to introduce attenuation adjacent to at least a portion of the interaction regions of the tube. For this purpose a common practice has been to provide coatings of attenuating material on the lateral surfaces of one or more of the slow-wave structure support rods. It has been found, however, that the attenuation provided by such arrangements increases significantly as the frequency of the rf fields along the slow-wave structure is increased. This results in a decrease in gain and power output at the higher frequency end of the operating bandwidth of the traveling-wave tube, a condition particularly troublesome for large bandwidth tubes.

Accordingly, it is an object of the present invention to provide an attenuation arrangement for a traveling-wave tube slow-wave structure which is less sensitive to frequency than the prior art, thereby enabling the achievement of a wide bandwidth traveling-wave tube having a more uniform gain and power output as a function of frequency.

It is a further object of the invention to provide a slow-wave structure support rod attenuation arrangement for a traveling-wave tube which facilitates the introduction of increased attenuation at the frequency or frequencies of maximum gain, thereby improving the stability of the traveling-wave tube.

An arrangement according to the invention includes a helical slow-wave structure and a plurality of dielectric support rods disposed about the peripheral surface of the slow-wave structure and extending parallel to the axis of the slow-wave structure. Each rod has a substantially rectangular cross-section and defines first and second opposing lateral surfaces disposed substantially circumferentially with respect to the slow-wave structure, as well as third and fourth opposing lateral surfaces disposed substantially radially with respect to the slow-wave structure. A coating of attenuating material is disposed on a portion of the third and fourth surfaces of at least one of the rods, with the first and second surfaces of the rod being free from attenuating material.

Figure 2:
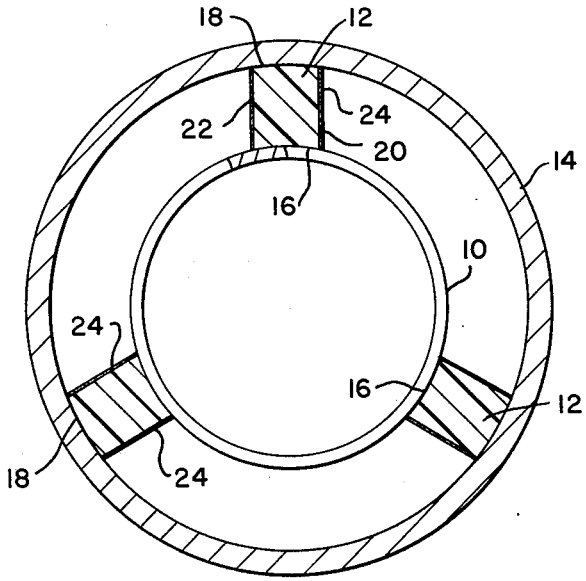

Additional objects, advantages and characteristic features of the invention will become readily apparent from the following detailed description of a preferred embodiment of the invention when considered in conjunction with the accompanying drawing wherein:

FIG. 1 is a longitudinal sectional view illustrating a slow-wave structure/support rod arrangement in accordance with the invention; and FIG. 2 is a cross-sectional view taken along line 2-2 of FIG. 1.

Referring to FIGS. 1 and 2 with greater particularity, there is shown a helix slow-wave structure 10 mounted on a plurality of longitudinally extending dielectric support rods 12 of a substantially rectangular cross-section. Although three rods 12 are shown equally circumferentially spaced about the helix 10, other numbers and orientations of the rods 12 may be employed. Helix 10 is of a metal such as tungsten or molybdenum, while rods 12 preferably consist of anisotropic boron nitride. The rods 12 are mounted within and supported by a tubular encasing barrel 14, of stainless steel, for example, coaxially disposed about the helix 10.

Each of the support rods 12 defines a first lateral surface 16 disposed substantially circumferentially with respect to the helix 10 and contacting the helix 10 and a second opposing lateral surface 18 also disposed circumferentially relative to the helix 10 but contacting the encasing barrel 14. The rod surfaces 16 and 18 are curved slightly so as to conform to the adjacent contacting surfaces of the helix 10 and the barrel 14, respectively. Each rod 12 further defines third and fourth opposing lateral surfaces 20 and 22, respectively, disposed substantially radially with respect to the helix 10.

In accordance with the principles of the invention, a coating 24 of attenuating material is disposed on a portion of the radially oriented surfaces 20 and 22 of at least one of the rods 12, with the circumferentially oriented rod surfaces 16 and 18 being free from attenuating material. The attenuating material for the coating 24 may be pyrolytic carbon or titanium carbide, for example. In a preferred embodiment of the invention, the coating 24 is provided on substantially longitudinally aligned portions of the radially oriented surfaces of each of the rods 12 and extends for about ⅔ of the length of the rod 12. Preferably, each coating 24 has a thickness which is tapered as a function of longitudinal distance along the rod from a minimum value at each end to a maximum value in the middle region in order to minimize the reflection of electromagnetic wave energy traveling along the slow-wave structure.

A specific exemplary slow-wave structure/support rod arrangement according to FIGS. 1–2 may employ a tungsten helix 10 having an inner diameter of 0.081 inch, an outer diameter of 0.097 inch, a helical conductor width (i.e., extent along the axial direction of the helix) of 0.025 inch, and a helix pitch (i.e., the axial distance in which the helical conductor makes one complete revolution about its axis) of 0.053 inch. Three anisotropic boron nitride support rods 12 of 7.5 inch length may be employed, with their circumferentially oriented surfaces 16 and 18 having an extent of 0.018 inch and their radially oriented surfaces 20 and 22 an extent of 0.023 inch in a cross-sectional plane. Pyrolytic carbon coatings 24 may be provided on substantially aligned portions of the radially oriented surfaces 20 and 22 of each of the rods 12. Each coating 24 may extend for 5.2 inches along the length of the rod 12 and may be tapered in thickness from about 1 A at each end to about 1 $\mu$m at the center.

It has been found that for a rod 12 having the aforedescribed exemplary parameters and provided with the aforedescribed exemplary attenuating coating 24 on its surfaces 20 and 22 in accordance with the invention, the attenuation measured at a location 4 inches from the end of the rod 12 increased by about 0.25 db as the frequency of rf energy propagating along the rod 12 was increased from 2.7 GHz to 5.4 GHz. In contrast, for an otherwise identical rod 12 but provided with an attenuating coating on all four of its lateral surfaces 16, 18, 20 and 22 in accordance with the prior art, a change in rf frequency from 2.7 GHz to 5.4 GHz resulted in about a 4 db increase in attenuation at the same location. Thus, it may be seen that the present invention provides an attenuation arrangement for a traveling-wave tube slow-wave structure which is far less sensitive to frequency than the prior art, thereby enabling the achievement of a wide bandwidth traveling-wave tube having a more uniform gain and power output as a function of frequency.

Although the present invention has been shown and described with respect to a particular embodiment, nevertheless various changes and modifications which are obvious to a person skilled in the art to which the invention pertains are deemed to lie within the spirit, scope and contemplation of the invention.

What is claimed is:

1. A slow-wave structure arrangement comprising:

a helical slow-wave structure;

a plurality of dielectric rods disposed about the peripheral surface of said slow-wave structure and extending parallel to the axis of said slow-wave structure, each of said rods having a substantially rectangular cross-section and defining first and second opposing lateral surfaces disposed substantially circumferentially with respect to said slow-wave structure and third and fourth opposing lateral surfaces disposed substantially radially with respect to said slow-wave structure; and at least one of said rods having a coating of attenuating material disposed on a portion of said third and fourth surfaces, with said first and second surfaces being free from attenuating material.

2. An arrangement according to claim 1 wherein said rods are of anisotropic boron nitride, and said attenuating material is pyrolytic carbon.

3. An arrangement according to claim 1 wherein said rods and said slow-wave structure are substantially coextensive along an axial direction, and said coating extends for about two thirds of the length of said rod.

* * * * *